US005946814A

United States Patent [19]

Farrant

[11] Patent Number: 5,946,814

[45] Date of Patent: Sep. 7, 1999

[54] ACCESSORY DRYER

[76] Inventor: Michael E. Farrant, 5065 Alexandria Dr., SW., Grandville, Mich. 49418

[21] Appl. No.: 09/062,103

[22] Filed: Apr. 17, 1998

[51] Int. Cl.[6] ..... F26B 25/00

[52] U.S. Cl. ..... 34/103; 34/106

[58] Field of Search ..... 34/90, 91, 103, 34/104, 105, 106, 107; 211/34, 35, 37; 248/160, 288.31, 314, 315, 910; D32/58

[56] References Cited

U.S. PATENT DOCUMENTS

| | | | |
|---|---|---|---|
| D. 194,512 | 2/1963 | Donaldson, Sr. | D49/1 |
| D. 208,372 | 8/1967 | Spangle | D49/1 |
| D. 213,129 | 1/1969 | Schenck | D49/1 |
| D. 310,742 | 9/1990 | Johnson | D32/58 |
| D. 322,344 | 12/1991 | Winkler | D32/58 |
| D. 347,094 | 5/1994 | Christensen, Jr. | D32/58 |
| D. 372,346 | 7/1996 | Marks | D32/8 |
| D. 373,867 | 9/1996 | Rask | D32/58 |
| 629,944 | 8/1899 | Witmer . | |
| 859,514 | 7/1907 | Peabody . | |
| 1,070,716 | 8/1913 | Myers . | |
| 3,645,009 | 2/1972 | Ketchum | 34/104 |
| 3,866,336 | 2/1975 | Bereza | 34/201 |
| 4,085,519 | 4/1978 | Masika | 34/104 |
| 4,136,464 | 1/1979 | Hay | 34/104 |
| 4,530,168 | 7/1985 | Petre | 34/106 |
| 4,596,078 | 6/1986 | McCartney | 34/103 |
| 4,873,773 | 10/1989 | Canonge | 34/90 |
| 5,117,565 | 6/1992 | Willenbacher, Jr. | 34/103 |
| 5,394,619 | 3/1995 | Kaplan | 34/90 |
| 5,692,316 | 12/1997 | Antal | 34/106 |
| 5,862,606 | 1/1999 | Jannach | 34/106 |

*Primary Examiner*—Henry Bennett
*Assistant Examiner*—Steve Gravini
*Attorney, Agent, or Firm*—Van Dyke, Gardner, Linn & Burkhart, LLP

[57] ABSTRACT

A dryer for drying accessories includes a support beam and a plurality of tubular members with air delivery passages extending therethrough. The support beam is adapted for positioning and aligning with a wall register of a heating and ventilation system and for aligning the tubular members with the wall register. The tubular members extend through the support beam and are cantilevered from the support beam for supporting one or more accessories thereon and for delivering air to the inside of the accessory. The support beam preferably includes a pair of base members which provide stability to the support beam when the tubular members support the one or more accessories thereon.

13 Claims, 2 Drawing Sheets

ACCESSORY DRYER

TECHNICAL FIELD AND BACKGROUND OF THE INVENTION

The present invention relates to a dryer and, more specifically, to a dryer for accessories, such as gloves, mittens, shoes or the like.

Conventional tumble dryers are often not well suited for drying accessories, such as shoes, gloves, or other vinyl or leather coated items. The heat that is normally associated with such tumble dryers tends to over heat the vinyl portions, adhesives, and/or leather portions used in such accessories, which leads to warping, cracking and/or melting the various heat sensitive components of the accessories.

Consequently, numerous rack clothes dryers have been proposed, which provide a frame that is positionable above a source of heat, including, for example a register of a heating system. In this manner, the heat that is emitted from the ventilation system gently dries the accessories without warping the vinyl or plastic or other heat sensitive components of the accessories.

For example, in U.S. Pat. No. 4,530,168 to Peter, a drying device is disclosed which includes a wall mounted rack. The rack includes a wall mounted track or rail on which a plurality of boot mounting brackets are slidably mounted. The boot mounting brackets are cantilevered from the mounting track or rail to position the boots above a conventional heat register. However, the '168 drying device requires a rigid surface on which the mounting track or rail can be mounted and, further, is not easily disassembled for storage.

U.S. Pat. No. 4,596,078 to McCartney discloses a drying device which includes a main body (3) which is adapted to fit over an outlet of a floor register. However, the McCartney device may permit unwanted moisture and/or debris to enter the duct of the ventilation system.

U.S. Pat. No. 5,394,619 to Kaplan discloses a portable clothes dryer and room humidifier. The clothes dryer includes a frame, which is adapted to fit within a hot air duct when the register of the duct is removed. The frame includes a passage which is in communication with the duct and includes a plurality of baffles (15) to direct the air from the duct and from the frame to the items supported on the shelves which extend from the frame. However, Kaplan's cloths dryer is relatively bulky and, like the McCartney drying device, may introduce moisture or debris into the duct of the ventilation system.

Consequently, there is a need for an accessory dryer which can gently dry accessories without over heating the heat sensitive components of the accessories. Preferably, the accessory dryer is portable and will not cause moisture or debris to enter the duct of the ventilation system.

SUMMARY OF THE INVENTION

Accordingly, the present invention provides a new and unique accessory dryer. The accessory dryer supports one or more accessories adjacent a wall register and directs air from the wall register to the accessory for gently drying the accessory.

In one form, an accessory dryer includes a support and at least one tubular member. The support is adapted to position adjacent a wall register and aligns the tubular member with the wall register so that air that flows from the wall register is directed into the tubular member which defines a conduit and directs the air into an accessory supported by the dryer.

In one aspect, the tubular member extends through the support and includes an open proximate end defining an inlet opening. Preferably, the tubular member includes an open distal end, which is cantilevered from the support and defines an outlet opening. In other aspects, the tubular member includes at least one radial aperture for directing air radially outward from the tubular member. In yet further aspects, the support includes at least one transverse opening. The tubular member is positioned in the transverse opening and projects outwardly from the transverse opening for extending into the article and supporting the article thereon. The tubular member is preferably secured in the transverse opening by a grommet, a threaded fastener, and/or an adhesive.

In another form of the invention, an accessory dryer includes a beam, a pair of base members supporting the beam, and at least one tubular member extending through the beam. The beam has a first side for facing a wall register and a second opposed side, with the tubular member projecting from the second opposed side of the beam between the base members. The base members are adapted for supporting the beam on a generally horizontal support surface and are adapted to space the beam from the generally horizontal support surface and to align the first side of the beam with the wall register. The tubular member is adapted to direct air from the wall register to an accessory for drying the accessory.

In one aspect the tubular member includes an inlet opening and an outlet opening. The inlet opening is adapted to align with the register, and the outlet opening is positioned for extending into the accessory for supporting the accessory thereon and drying the accessory. Preferably, each of the base members has an upper portion and a lower portion, wherein at least one of the base members has a wider lower portion than upper portion. The wider lower base portion rests on the support surface and stabilizes the dryer when the dryer supports one or more accessories.

In preferred form, the accessory dryer includes two or more of the tubular members. For example, the tubular members may be arranged in at least one row, with the tubular members being spaced apart for supporting two or more accessories. In other aspects, the tubular members are arranged in two or more rows. Preferably, the tubular members comprise metal tubular members, which provides a source of radiant heat and, thereby, increases the drying efficiency of the dryer. For example, the metal tubular members may comprise aluminum tubing, stainless steel tubing, copper tubing, or brass tubing.

In yet another form of the invention, an accessory dryer includes a beam and a plurality of tubular members extending through and being cantilevered from the beam for supporting at least one accessory thereon. The beam is adapted for positioning adjacent and aligning with a wall register and is adapted to support the tubular members on a generally horizontal support surface and to resist over turning when the tubular members support one or more accessories thereon. The tubular members define air delivery passages, which align with the wall register and direct air from the wall register to the accessory for drying the accessory.

In one aspect, the beam includes at least one base member extending below and rearwardly of the beam for spacing the beam above the generally horizontal support surface and for stabilizing the dryer, and the tubular members extend rearwardly from the beam.

Preferably, the beam includes a pair of the base members, with the tubular members extending rearwardly of the beam between the pair of base members.

In other aspects, the beam and the beam members are integrally molded from a heat resistant plastic.

From the foregoing, it can be appreciated that a light weight portable accessory dryer is provided which permits use of a heating and ventilation system to gently dry accessories supported thereon without introducing moisture or debris into the ventilation system. These and other objects, advantages, purposes and features of the invention will become more apparent from a study of the following description taken in conjunction with the drawings.

BRIEF DESCRIPTIONS OF THE DRAWINGS

DESCRIPTION OF THE PREFERRED EMBODIMENT

Figure 1:
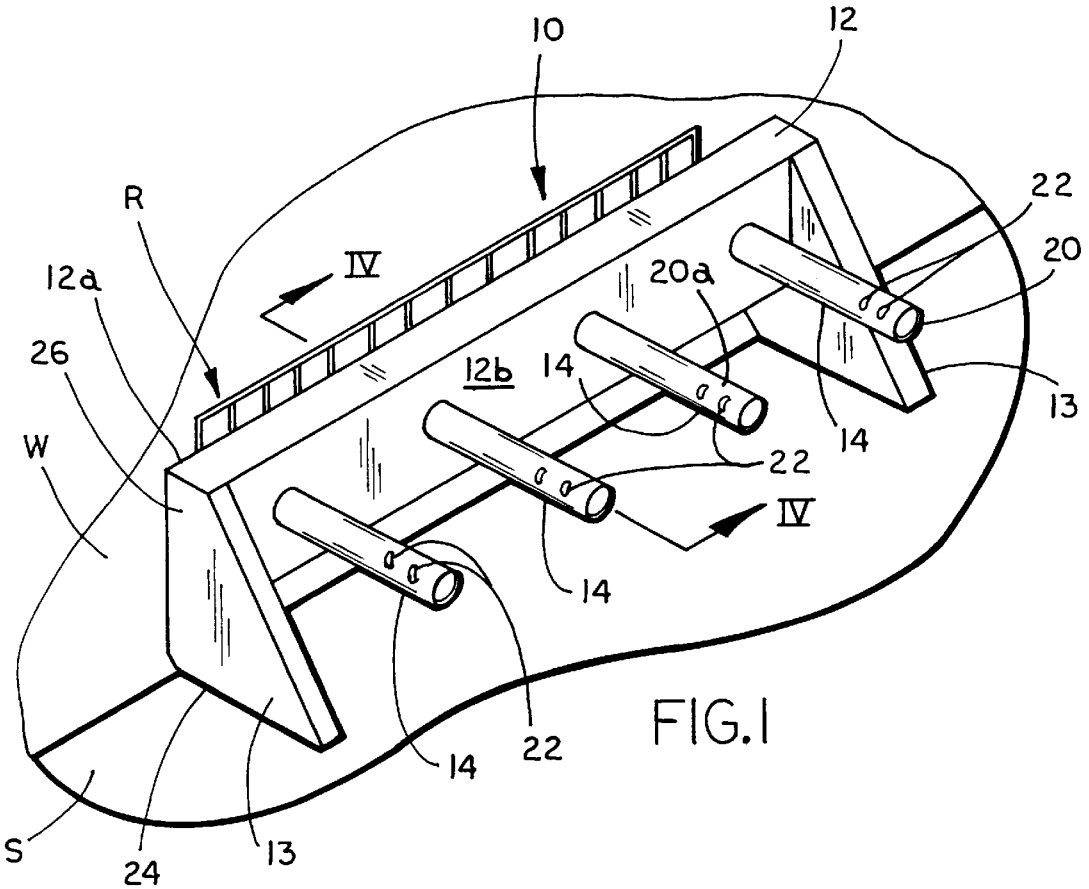
FIG. 1 is a perspective view of an accessory dryer of the present invention.

Referring to FIG. 1, numeral 10 generally designates an accessory dryer of the present invention, which is particularly suitable for positioning adjacent a wall register R of a heating and ventilation system mounted in a wall W, for drying accessories such as gloves, mittens, shoes, or boots.

Dryer 10 includes a support beam 12, which is supported by a pair of base members 13, and a plurality of hollow tubular members or tubes 14. Tubular members 14 extend or project outwardly from support beam 12 for supporting the accessories adjacent wall register R in a manner to permit the heat or air which is directed from wall register R to be directed to the accessories for drying the accessories in a gentle manner so that the warping, melting, and/or cracking which is associated with conventional tumble drying is eliminated.

Tubular members 14 are positioned in transverse openings 16 provided in support beam 12 which extend from a first face 12*a* to a second opposed face 12*b* of support beam 12. Tubular members 14 may be secured in the respective transverse openings 16 by a friction fit, for example in a grommet 15, or by an adhesive or a fastener or the like. Alternately, transverse openings 16 may be threaded or include a threaded collar with the respective tubular member being similarly threaded so that the tubular members are removably mounted to support beam 12. Transverse openings 16 are preferably spaced apart to permit each tubular member 14 to support an accessory thereon. In addition, in the illustrated embodiment, transverse openings 16 are arranged in a row. It should be understood that transverse openings 16 may optionally be arranged in other geometric arrangements or in a random fashion. Additionally, as described in reference to the second embodiment, two or more rows of openings 16 may optionally be provided to increase the capacity of the dryer 10.

Each tubular member 14 includes a delivery passage 14*a*, an inlet opening 14*b* at a proximate end 18, and an outlet opening 14*c* at a distal end 20. Preferably, tubular members 14 are positioned in respective transverse openings 16 such that their proximate ends 18 are substantially aligned with first face 12*a* of support beam 12 so that warm air directed from the wall register will enter inlet openings 14*b* of the respective tubular members 14. Distal ends 20 of tubular members 14 are cantilevered from support beam 12 at a distance sufficient to extend into a respective accessory and, preferably, to provide a support surface for the accessory. It should be understood from the foregoing, that the length of tubular members 14 and the spacing between tubular members 14 may be varied to accommodate a wide variety of accessories. Moreover, more than one tubular member may extend into each accessory. Thus, when air is directed from register R and into the open proximate ends 18 of tubular members 14, tubular members 14 direct air into the accessories for drying the accessories which are supported thereon or otherwise propped up by tubular members 14.

In addition, tubular members 14 preferably comprise metal tubular members or tubing, for example aluminum, stainless steel, brass, or copper tubes or tubing. In this manner, in addition to providing conduits for directing the warm air to enter the accessories, tubular members 14 provide radiant heat and act as radiators when warm air is passed through the tubular members due to the heat capacity of the metal material, thus increasing the drying efficiency of the dryer.

Furthermore, tubular members 14 may optionally include one or more radial apertures 22 or may comprise foraminous tubular members so that heat is directed radially outward from tubular members 14. Apertures 22 may be localized at the end portions 20*a* of tubular members 14 to assure that the warm air is primarily directed into the accessory so that the accessory is dried from the inside out.

Figure 2:
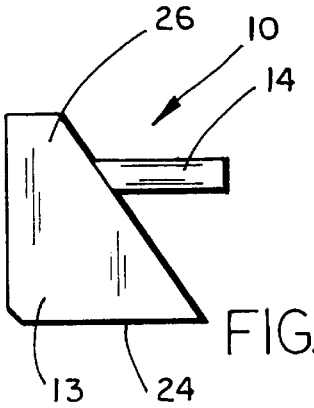
FIG. 2 is a side view of the dryer of FIG. 1.
Figure 4:
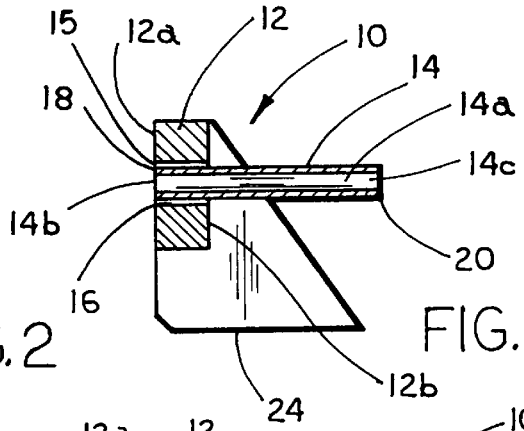
FIG. 4 is a cross-section taken along line IV—IV of FIG. 1.
Figure 3:
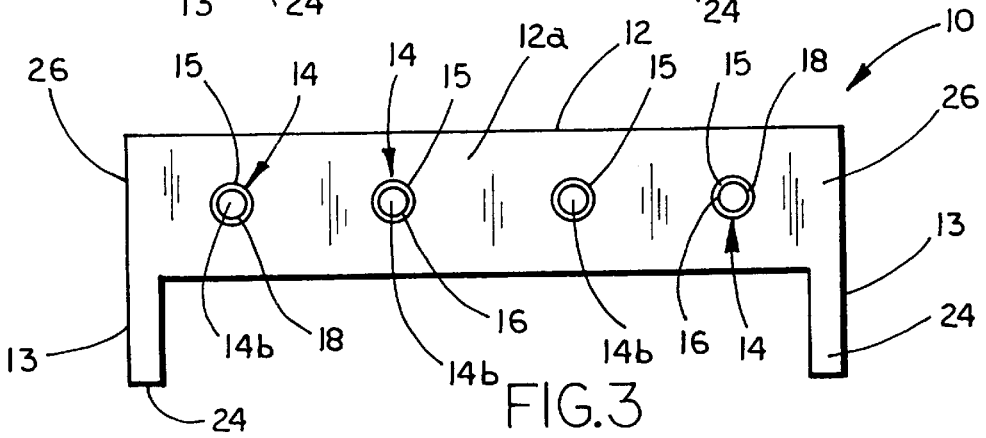
FIG. 3 is a rear elevation of the dryer of FIG. 1.

Since tubular members 14 tend to over turn support beam 12, support beam 12 includes, or is preferably supported between, stabilizing base members 13. As best seen in FIGS. 2 and 4, base members 13 are generally triangular in shape with a wider lower support surface engaging portion 24 than upper portion 26. Base members 13 space support beam 12 from a generally planar horizontal support surface S and align support beam 12 with wall register R so that tubular members 14 are also aligned with wall register R. Base members 13 stabilize support beam 12 so that even when tubular members 14 are loaded with the varying accessories, dryer 10 will remain generally upright and can remain positioned adjacent wall register R of the heating and ventilation system. In this manner, air, preferably warm, which is directed through register R is channeled through tubular members 14 and directed to the inside of the accessories by open end 14*b* of tubular members 14 and, optionally, through apertures 22. Consequently, the accessories are gently dried by the flow of warm air which is directed inside the accessories by tubular members 14.

Base members 13 and support beam 12 may be integrally formed as a unitary member from a plastic material which has high heat resistance, for example polyvinyl chloride (PVC). Alternately, support beam 12 and base members 13 may comprise discrete plastic elements which are then secured together by conventional fasteners or by plastic welding. In addition, support beam 12 and base members 13 may comprise wood members which are secured together by an adhesive or by other conventional fastening methods including, for example nails, screws, bolts, or dowels. Optionally, support beam 12 and base members 13 may comprise metal members which are secured together by conventional fastening methods such as screws, rivets, or the like or by welding.

It should be understood from the foregoing that the number of tubular members 14 may be increased or decreased and may be spaced closer together or further apart to accommodate various sizes of accessories.

Figure 5:
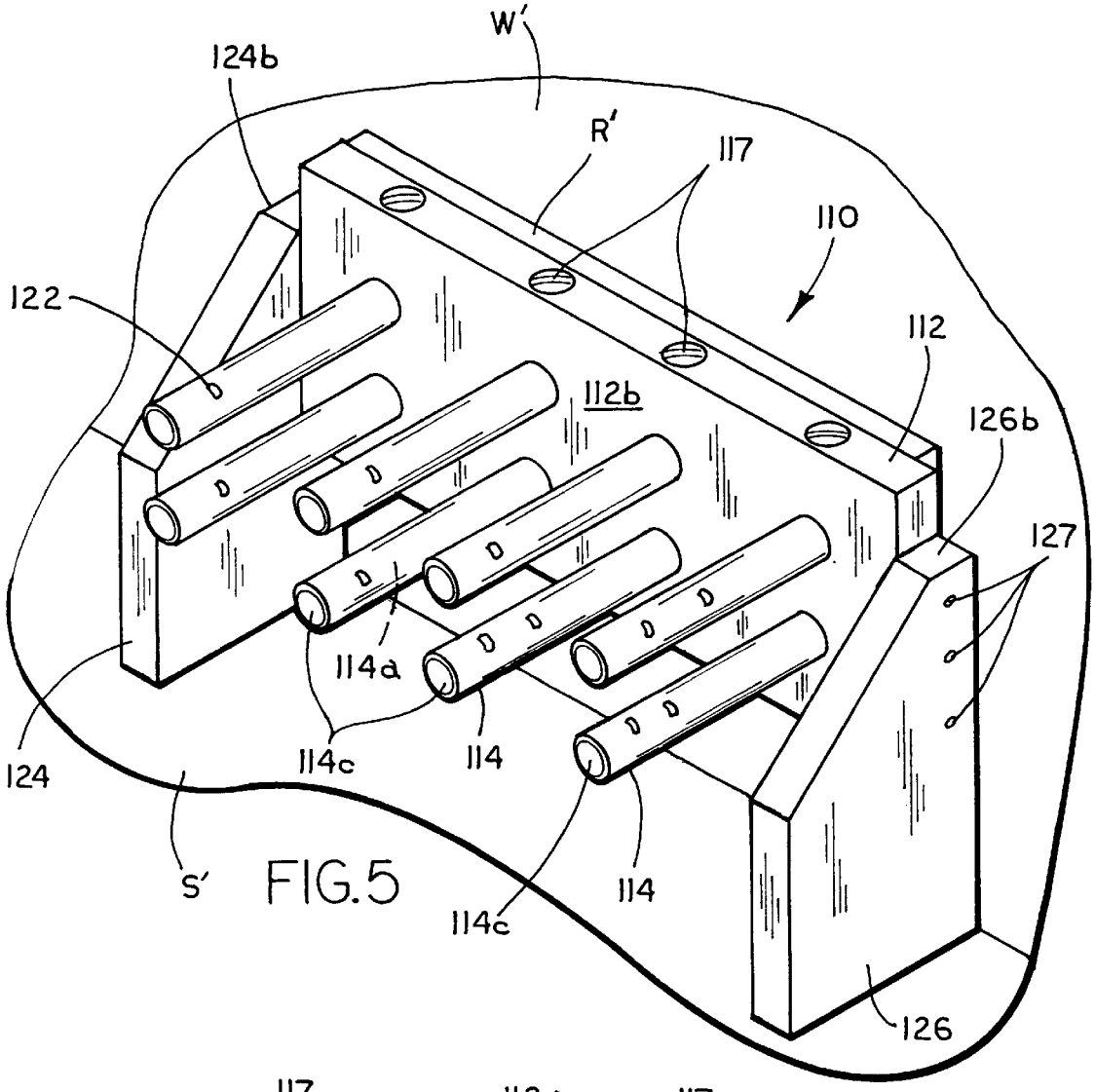
FIG. 5 is a perspective view of a second embodiment of the dryer of the present invention.

Referring to FIG. 5, second embodiment 110 of the dryer is illustrated. Dryer 110 includes a support beam 112 with a plurality of transverse passages 116, which extend from a first face 112*a* to a second face 112*b* of support beam 112. Similar to the first embodiment, positioned and supported in each of the transverse passages 116 is a elongated hollow tubular member 114 which includes a delivery passageway 114*a* and first and second opposed open ends 114*b* and 114*c* which respectively define inlet and outlet openings. Optionally, tubular members 114 may include one or more radial apertures 122 to direct air radially outward from tubular members 114.

Figure 6:
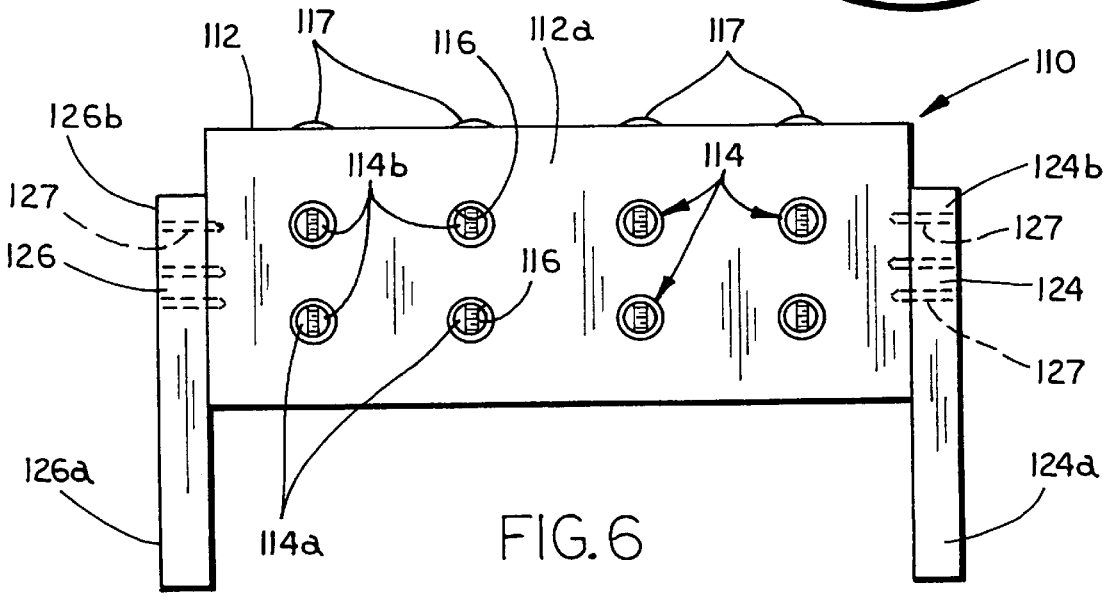
FIG. 6 is a rear elevation view of the dryer of FIG. 5.

As best seen in FIG. 6, in the illustrated, tubular members 114 are secured in transverse passages 116 by fastener 117, such as a screw, which extend through beam 112 and through vertically aligned transverse openings 116 and the respective tubular members 114 positioned in the vertically aligned transverse passages. Furthermore, in this embodiment, two rows of tubular members 114 are provided to increase the capacity of dryer 110.

Support beam 112 is supported between a pair of opposed base members 124 and 126 which are adapted to space support beam 112 from a generally planar support surface S' to align beam 112 with a wall register R' mounted in a wall W'. In this embodiment, base members 124 and 126 are generally trapezoidal shape members with wider lower portions 124*a* and 126*a* than upper portions 124*b* and 126*b* to thereby provide a stable base for support member 112 and its plurality of tubular members 114.

As best seen in FIG. 5, support beam 112 is secured between upper portions 124*b* and 126*b* of base members 124 and 126 with fasteners 127 such that tubular members 114 project inwardly and rearwardly between base members 124 and 126 to provide a stable configuration for dryer 110.

Tubular members 114 are similar in construction to tubular members 14 of the first embodiment and, therefore, reference is made to tubular members 14 for further details. However, in this embodiment, two rows of tubular members 114 are provided to increase the capacity of dryer 110 and, optionally, to hold larger accessories.

Preferably, support beams 12 and 112 are sized to substantially cover the outlet opening of register R or R' so that preferably all or at least a high proportion of the air which is directed through register R or R' is channeled through tubular members 14 or 114. In addition, it should be understood that the height of the base members (13, 124, and 126) may be adjusted to accommodate wall registers with different locations.

While several forms of the invention have been shown and described, other forms will now become apparent to those skilled in the art. For instance, the length of the tubular members 14 and 114 may be increased or decreased to provide support for a variety of accessories. In addition, more than two rows of tubular members 14 or 114 may be provided to increase the capacity of dryer 10 or 110. While the support beam 12 or 112 is illustrated with a solid rectangular cross-section, bean 12 or 112 may assume other shapes or configurations including, for example tubular or angle or channel shaped members. Moreover, as described above, tubular members 14 or 114 may comprise foraminous tubular members to increase the radial flow of air from tubular members 14 or 114. It should also be understood that tubular members 14 or 114 may be formed from material other than metal, for example, plastic or wood. However, non-metal tubular members would not provide the enhanced drying that is associated with the radiator characteristics of the metal tubular members.

The embodiments of the invention which I claim exclusive property or privilege is defined as follow:

1. An accessory dryer comprising:

a beam having a first side for facing a wall register and a second opposed side;

a pair of base members supporting said beam, said base members being adapted for supporting said beam on a generally horizontal support surface and adapted to space said beam from the generally horizontal support surface and to align said first side of said beam with a wall register; and at least one tubular member extending through said beam and projecting from said second opposed side of said beam between said base members, and said tubular member being adapted to direct air from the wall register to an accessory for drying the accessory.

2. The accessory dryer according to claim 1, wherein said tubular member includes an inlet opening and an outlet opening, said inlet opening being adapted to align with the wall register, and said outlet opening being positioned for extending into the accessory for supporting the accessory thereon and drying the accessory.

3. The accessory dryer according to claim 1, said base members having an upper portion and a lower portion, wherein at least one of said base members has a wider lower portion than upper portion, and said wider lower base portion for resting on the support surface and stabilizing said dryer.

4. The accessory dryer according to claim 1, further comprising a plurality of said tubular members.

5. The accessory dryer according to claim 4, wherein said tubular members are arranged in at least one row, said tubular members being spaced apart for supporting a plurality of the accessories.

6. The accessory dryer according to claim 4, wherein said tubular members are arranged in two or more rows.

7. The accessory dryer according to claim 1, wherein said tubular member comprises a metal tubular member to provide a source of radiant heat and, thereby, increase the drying efficiency of the dryer.

8. The accessory dryer according to claim 7, wherein said metal tubular member comprises one of aluminum, stainless steel, copper tubing, or brass.

9. An accessory dryer comprising:

a beam adapted for positioning adjacent and aligning with a wall register;

a plurality of tubular members extending through and being cantilevered from said beam for supporting at least one accessory thereon, said tubular members defining air delivery passages, and said air delivery passages for aligning with the wall register and for directing air from the wall register to the accessory for drying the accessory, and said beam being adapted to support said tubular members on a generally horizontal support surface and adapted to resist over turning when said tubular members support at least one accessory thereon.

10. The accessory dryer according to claim 9, wherein each of said tubular members includes one or more radial apertures from delivering air radially outward from each respective tubular members.

11. The accessory dryer according to claim 9, wherein said tubular members extend rearwardly from said beam, said beam including at least one base member extending below and rearwardly of said beam for spacing said beam above said generally horizontal support surface and for stabilizing said dryer.

12. The accessory dryer according to claim 11, wherein beam includes a pair of said base members, at least one of said tubular members extending rearwardly of said beam between said base members.

13. The accessory dryer according to claim 12, wherein said beam and said beam members are integrally molded from a heat resistant plastic.

* * * * *